US005962177A

United States Patent [19]

Sacripante et al.

[11] Patent Number: 5,962,177

[45] Date of Patent: Oct. 5, 1999

[54] POLYESTER TONER COMPOSITIONS AND PROCESSES THEREOF

[75] Inventors: Guerino G. Sacripante, Oakville; Walter Mychajlowskij, Georgetown; Beng S. Ong, Mississauga, all of Canada

[73] Assignee: Xerox Corporation, Stamford, Conn.

[21] Appl. No.: 08/786,540

[22] Filed: Jan. 21, 1997

[51] Int. Cl.[6] ..... G03G 9/097; G03G 9/087

[52] U.S. Cl. ..... 430/110; 430/110

[58] Field of Search ..... 430/109, 110

[56] References Cited

U.S. PATENT DOCUMENTS

| | | | |
|---|---|---|---|
| 3,590,000 | 6/1971 | Palermiti et al. . | |
| 3,681,106 | 8/1972 | Burns et al. . | |
| 4,105,572 | 8/1978 | Gorondy | 430/106 |
| 4,113,493 | 9/1978 | Sandhu et al. . | |
| 4,415,645 | 11/1983 | Kouchi et al. | 430/111 |
| 4,478,923 | 10/1984 | De Roo et al. | 430/110 |
| 4,533,614 | 8/1985 | Fukumoto et al. | 430/99 |
| 4,565,763 | 1/1986 | Uchiyama et al. | 430/109 |
| 4,585,723 | 4/1986 | Kishi et al. | 430/110 |
| 4,840,863 | 6/1989 | Otsu et al. | 430/110 |
| 5,272,029 | 12/1993 | Sakai et al. | 430/58 |
| 5,352,556 | 10/1994 | Mahabadi et al. | 430/110 |

*Primary Examiner*—Roland Martin
*Attorney, Agent, or Firm*—John L. Haack

[57] ABSTRACT

A toner composition comprised of a pigment, and a linear polyester resin of the formula

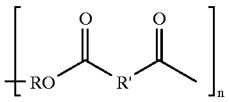

where R' is independently selected from the group consisting of phenylene, cyclohexylene, and alkylene with from 4 to about 24 carbon atoms, where R is an oxyalkylene group of the formula

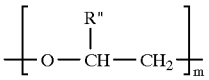

where R" is independently selected from the group hydrogen and hydrocarbon substituents with from 1 to about 24 carbon atoms, n is an integer from about 2 to about 10,000, and m is an integer from about 2 to about 10,000.

29 Claims, No Drawings

POLYESTER TONER COMPOSITIONS AND PROCESSES THEREOF

CROSS REFERENCE TO COPENDING APPLICATIONS AND RELATED PATENTS

Attention is directed to commonly owned and assigned U.S. Pat. Nos. 4,513,074; 4,876,169; 4,952,477, 5,368,970; 5,370,962; 5,391,452, 5,414,052; 5,227,460; 5,393,630; 5,401,602; 5,407,772; and 5,446,554.

Attention is directed to commonly owned and assigned copending applications Application Numbers: U.S. Ser. No. 08/100,937 (D/93132) filed Aug. 3, 1993, entitled "POLYESTER WITH UNSATURATED END GROUPS FOR TONER RESINS", now abandoned, discloses polyester resins having a monofunctional, unsaturated end group located on at least one end of the polyester chain; U.S. Ser. No. 08/393,606 (D/93426) filed Feb. 23, 1995, entitled "PROCESSES FOR THE PREPARATION OF TONER", now U.S. Pat. No. 5,536,613, discloses a process for the preparation of pigmented toner compositions comprising: forming at a first temperature, a first melt mixture comprised of a partially crosslinked thermoplastic resin, pigment, and optionally a wax, wherein the partially crosslinked thermoplastic resin is comprised of a mixture of crosslinked resin macrogel particles, crosslinked resin microgel particles, and uncrosslinked resin; and melt mixing at a second temperature, the first melt mixture to form a second mixture, wherein the macrogel particles are partially converted into microgel particles, and wherein the second temperature is less than or equal to the first temperature; and U.S. Ser. No. 08/369,630 (D/93629) filed Jan. 6, 1995, entitled "TONER AND DEVELOPER COMPOSITIONS", now U.S. Pat. No. 5,698,422, which discloses a toner composition comprised of a polyester resin with hydrophobic end groups, pigment, optional wax, optional charge additive, and optional surface additives wherein hydrophobic end group is a hydrocarbon with from about 2 to about 24 carbon atoms.

The disclosures of each the above mentioned documents of patents and pending applications are incorporated herein by reference in their entirety.

BACKGROUND OF THE INVENTION

The present invention is generally directed to toner and developer compositions, and more specifically, present invention is directed to developer and toner compositions containing novel linear polyester resins, and processes for the preparation and use thereof. In embodiments, there are provided in accordance with the present invention toner compositions comprised of certain polyester resin particles, and pigment particles comprised of, for example, carbon black, magnetites, or mixtures thereof, and/or other colored pigment particles, such as a cyan, magenta, yellow, blue, green, red, or brown components, or mixtures thereof thereby providing for the development and generation of black and/or colored images. In embodiments, there are provided in accordance with the present invention toner compositions comprised of a pigment, and a linear polyester resin of the formula

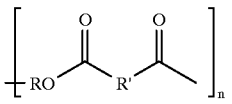

where R' is independently selected from the group consisting of phenylene, cyclohexylene, and alkylene with from 4 to about 24 carbon atoms, where R is of the formula

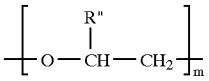

representing either an oxyalkylene group or a condensed mixture of oxyalkylene and diol groups, wherein R" is independently selected from the group hydrogen and hydrocarbon substituents with from 1 to about 24 carbon atoms, n is an integer from about 2 to about 10,000, and m is an integer from about 2 to about 10,000.

In embodiments, there are provided in accordance with the present invention processes for the preparation of the abovementioned linear polyesters and branched polyesters thereof.

The toner compositions of the present invention, in embodiments, possess a number of advantages including low melting characteristics, broad fusing latitudes, excellent blocking characteristics, excellent admix characteristics, are of low cost, and possess excellent non vinyl-offset properties. The toner compositions of the present invention can in embodiments be prepared by conventional condensation polymerization processes, for example, as disclosed in U.S. Pat. No. 5,391,452, and as illustrated herein. The polyester toner resins of the present invention can in embodiments be generated by a process involving (a) melt polycondensation of about 0.9 mole equivalent to about 1.1 mole equivalents of a diol or mixture of diols such as 1,2-propane diol and or a polyoxyalkylene glycol with about 0.9 mole equivalents to about 1.1 mole equivalents of a diacid such as terephthalic acid or diesters thereof such as dimethyl terphthalate, yielding a polyester oligomer or polymer with a degree of polymerization which is readily controlled by the operator, and with a number average molecular weight(Mn) of from about 2,000 grams per mole to about 100,000 grams per mole, a weight average molecular weight(Mw) of from about 4,000 grams per mole to about 250,000 grams per mole as measured by gel permeation chromatography, and polydispersity of from about 1.8 to about 17.

In other embodiments of the present invention, there may be included in the reaction mixture a branching agent in amounts of from about 0.1 to about 5.0 weight percent based on the total weight of the polyester reactant constituents, to provide branched polyester which possess the aforementioned desirable resin properties.

PRIOR ART

The following United States patents are noted as being of interest to the background of the present invention.

U.S. Pat. No. 3,590,000,
Patentee: Palmeriti et al.,
Issued: Jun. 29, 1971
U.S. Pat. No. 3,681,106,
Patentee: Burns et al.,
Issued: Aug. 1, 1972
U.S. Pat. No. 5,272,029,
Patentee: Sakai et al.,
Issued: Dec. 21, 1993
U.S. Pat. No. 4,113,493,
Patentee: Sandu et al.,
Issued Sep. 12, 1978
U.S. Pat. No. 4,533,614,
Patentee: Fukumoto et al.,
Issued: Aug. 6, 1985,
U.S. Pat. No. 4,478,923,
Patentee: De Roo et al.,
Issued: Oct. 23, 1984

Some relevant portions of the foregoing patents may be briefly summarized as follows:

U.S. Pat. No. 3,590,000, issued Jun. 29, 1971, Palmeriti et al., discloses a finely-divided, rapid melting toner comprising a colorant, a solid, stable hydrophobic metal salt of a fatty acid, and a polymeric esterification product or a dicarboxylic acid and a diol comprising a diphenol, see structures in col. 4 line 30 and col. 6, line 35.

U.S. Pat. No. 3,681,106, issued Aug. 1, 1972, to Burns et al., discloses electrostatic compositions which comprise a toner containing a coloring agent and a polyester resin, and can include carrier particles. The polyester resin is prepared from a dicarboxylic acid and a polyhydroxy composition which contains an alkylene oxide derivative of a bisphenol and an alkylene oxide derivative of a second polyhydroxy compound, see for example, col. 4 line 56 to 63.

U.S. Pat. No. 5,272,029, issued Dec. 21, 1993, to Sakai et al., discloses an image-bearing member suitable for carrying an electrostatic image and/or toner image is formed by forming a surface layer on a substrate or a photosensitive layer. The surface layer comprising a high-melting point polyester resin shows a good dispersability of the cured resin to provide a durable layer in combination with the cured resin, and also a lubricant, preferably a silicone-type one, whereby the surface layer provides an image-bearing surface suitable for electrophotography. The surface layer may be a protective layer or a photoconductive layer when it constitutes a photosensitive member. Example 1A-3 discloses a high melting point polyester resin prepared condensing, for example, a terephthalic acid, a glycol mixture of 40 mol percent ethylene glycol and 60 mol percent polyethylene glycol, and a silicone-grafted polymer.

U.S. Pat. No. 4,113,493, issued Sep. 12, 1978, to Sandu et al., discloses heat-activatable adhesive compositions comprising an amorphous condensation polymer which is characterized by having an acid component comprising a phthalic acid derivative and a glycol component comprising from about 15 to about 85 mol percent of 1) a linear aliphatic glycol having the formula HO—R—H wherein R is arises from 1,4-bis(2-hydroxyethoxy)cyclohexane or $—(CH_2CH_2—O)_n—$ wherein n is an integer from 2 to 4; and from about 85 to about 15 mole percent of 2) a branched aliphatic glycol having the structure $C(R^1R^2)(CH_2—OH)_2$ wherein $R_1$ and $R^2$ are alkyl. These polyester adhesives are further characterized as being soluble in halogenated solvents, having glass transition temperatures within the range of about −30° to about 50° C., and having high bonding strengths at elevated temperatures. They have been found to be useful in a variety of photographic materials, and particularly in photographic film units.

U.S. Pat. No. 4,533,614, issued Aug. 6, 1985, to Fukumoto et al., discloses a toner, fixable sufficiently at low temperatures to afford energy saving, particularly suitable for high speed fixing and also good in off-set resistance with a broad applicable temperature range for fixing is obtained from a heat-fixable dry system toner comprising in a binder resin a non-linearly modified low melting polyester having an acid value of 10 to 60 obtained from components containing (A) an alkyl-substituted dicarboxylic acid and/or an alkyl-substituted diol, (B) a trivalent or more polycarboxylic acid and/or trivalent or more polyol, (C) a dicarboxylic acid, and (D) and etherated diphenol.

U.S. Pat. No. 4,478,923, issued Oct. 23, 1984, to De Roo et al., discloses a toner composition of electrostatically attractable fusible powder particles suitable for fixing with simultaneous heat and pressure, having a melt viscosity at 140° C. in the range of $10^5$ to $10^6$ mPa-sec, an average particle size range in the range of 1 to 50 microns, and comprising a coloring substance and more than 80 percent of their volume of a mixture of: a combination of fumaric, bisphenolic and fumaric, propoxylated bisphenolic polyester resins, a sterically-hindered phenol release agent, and a melt-viscosity controlling pigment, e.g. barium sulfate.

The disclosures of each of the aforementioned documents are totally incorporated herein by reference.

Semicrystalline polyolefin resins or blends thereof are illustrated in commonly owned U.S. Pat. Nos. 4,990,424 and 4,952,477. Specifically, in U.S. Pat. No. 4,952,477 there are disclosed toners with semicrystalline polyolefin polymer or polymers with a melting point of from about 50 to about 100° C., and preferably from about 60° to about 80° C. Examples include poly-1-pentene; poly-1-tetradecene; and the like, and mixtures thereof. The materials are particularly suitable for making matte or low gloss black copies and prints.

The disclosures of each of the aforementioned patents are totally incorporated herein by reference.

In the process of electrophotographic printing, a photoconductive member is uniformly charged and exposed to a light image of an original document. Exposure of the photoconductive member records an electrostatic latent image corresponding to the informational areas contained within the original document. After the electrostatic latent image is recorded on the photoconductive surface, the latent image is developed by bringing a developer material into contact therewith. This forms a powder image on the photoconductive member which is subsequently transferred to a receiver sheet and permanently affixed thereto in image configuration.

In view of continued demand for improved electrophotographic printing processes that perform at higher speeds and consume less energy there continues to be a need for improved toner resins and toner compositions which can satisfy the rheological performance and thermal efficiency requirements of the improved printing processes. The present invention in embodiments provides improved toner resins and toner composition therefrom with improved melt properties.

Solutions to the above problems and needs have been found with the compositions and processes, in embodiments, of the present invention wherein there is provided toner compositions comprised of low melting resins including linear polyesters, branched polyesters, or mixtures thereof.

SUMMARY OF THE INVENTION

Some examples of features of the present invention include:

overcoming or minimizing problems encountered in the art by providing toner compositions comprised of low melt polyester toner resins;

providing processes for readily and economically preparing toner compositions comprised of low melt polyester toner resins;

providing, in embodiments, amorphous and semicrystalline polyester resins which are suitable for use as toner resins that possess excellent glass transition temperatures, low minimum fix temperatures, and broad fusing latitudes; and providing linear and branched polyester based resin toner compositions with high triboelectric charging; high relative humidity stability; and high jetting rate properties.

DETAILED DESCRIPTION OF THE INVENTION

The present invention relates in embodiments, a toner composition comprised of a pigment, and a linear polyester resin of the formula

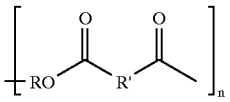

where R' is independently selected from the group consisting of phenylene, cyclohexylene, and alkylene with from 4 to about 24 carbon atoms, where R is an oxyalkylene group of the formula

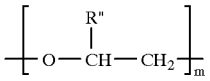

where R" is independently selected from the group hydrogen and hydrocarbon substituents with for example from 1 to about 24 carbon atoms, n is an integer of for example from about 2 to about 10,000, and m is an integer of for example from about 2 to about 10,000.

In other embodiments of the present invention, there are provided toner compositions comprised of polyesters resin which can be amorphous, semicrystalline, or mixtures thereof.

Toners of the present invention in embodiments are comprised of polyester resins that exhibit glass transition temperatures of from about 50 to about 65° C., low minimum fix temperatures of from about 120 to about 165° C., and broad fusing latitudes, for example, of from about 20 to about 45° C. A preferred polyester toner resin of the present invention has a minimum fix temperature of from about 127° C. (F-45) to about 144° C. as illustrated herein.

Toner compositions of the present invention exhibit high positive or negative triboelectric charging properties of for example from about 10 to about 30, and preferably from about 1.0 to about 2.5, and a high relative humidity stability of from about 1.0 to about 2.8. These toners also possess high jetting rates, for example, jetting particulate toners in a jet mill or classifier, and with jetting ratios less than or equal to about 1. The jetting ratio is the jetting rate observed for a control toner, for example, a Xerox Model 3100 toner comprised of a SPAR II resin available from Goodyear Corp., over the jetting rate observed for an Example toner of the present invention.

The toner compositions of the present invention can further comprise polyester resins comprised of certain amounts of a branching agent to provide a branched polyester wherein the branching agent is, for example, trimethylolpropane, pentaerythritol, trimellitic acid, pyromellitic acid, and mixtures thereof, and which branching agent can be present in amounts of from 0.1 to about 5 percent by weight based on the total weight percent of the polyester constituents or on the weight of the resulting branched polyester product.

In embodiments, the toner compositions of the present invention are comprised of linear or branched polyester resins which possess a number average molecular weight (Mn) of from about 2,000 grams per mole to about 100,000 grams per mole, a weight average molecular weight(Mw) of from about 4,000 grams per mole to about 250,000 grams per mole, and polydispersity of from about 1.8 to about 17. Preferably, the Mn is from about 6,000 to about 40,000, and Mw is from about 25,000 to about 250,000 g/mole, and the polydispersity is from about 2.0 to about 6.

Toner compositions of the present invention include linear and branched polyesters comprised of at least one diacid component and at least one diol component in a mole ratio of from about 0.9:1.1 to about 1.1:0.9. In embodiments, from 2 to about 10 different diol compounds are selected for the diol or oxyalkylene component. Likewise, from 2 to about 10 different diacids can be selected as the diacid component in preparing the polyester.

Diacid compounds suitable for use in the present include, but are not limited to malonic acid, succinic acid, 2-methylsuccinic acid, 2,3-dimethylsuccinic acid, dodecylsuccinic acid, glutaric acid, adipic acid, 2-methyladipic acid pimelic acid, azealic acid, sebacic acid, terephthalic acid, isophthalic acid, phthalic acid, cyclohexanedioic acid, glutaric anhydride, succinic anhydride, phthalic anhydride, and alkyl diesters of the aforementioned diacids wherein the alkyl groups contain from 1 to about 20 carbon atoms, for example, methyl, ethyl, propyl, butyl, pentyl, hexyl, and the like, and mixture thereof. Effective amounts of diacid or diester, are for example, from about 45 to about 55 mole percent of the resin.

Oxyalkylene, glycol, and diol compounds suitable for use in the present include, but are not limited to, dipropylene glycol, dibutylene glycol, dipentylene glycol, dihexylene glycol, triethylene glycol, tripropylene glycol, tributylene glycol, tripentylene glycol, trihexylene glycol, tetraethylene glycol, tetrapropylene glycol, tetrabutylene glycol, tetrapentylene glycol, tetrahexylene glycol, polyethylene glycol with average molecular weight of from about 200 to about 10,000, polypropylene glycol with average molecular weight of from about 200 to about 10,000, polybutylene glycol with average molecular weight of from about 200 to about 10,000, polyhexylene glycol with average molecular weight of from about 200 to about 10,000, and the like, and mixture thereof. Effective amounts of oxyalkylene, glycol, and or diol compounds are for example, from about 45 to about 55 mole percent of the resin.

Preferred diacids or diesters are terephthalic acid or dimethyl terephthalate, and isophthalic acid, and preferred glycols are dipropylene glycol, triethylene glycol, polyethylene glycol and polypropylene glycol.

Examples of preferred polyesters of the present invention include poly(dioxypropylene -terephthalate). poly (trioxypropylene-terephthalate). poly(trioxyethylene-terephthalate), and poly(tetraoxyethylene-terephthalate).

Thus, in embodiments of the present invention, there are provided polyester resins is of the formula

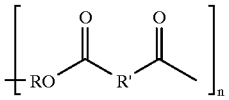

where R' is independently selected from, for example, phenylene, cyclohexylene, and alkylene with from 4 to about 24 carbon atoms, where R is of the formula

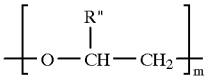

representing a group comprised of one or more oxyalkylene compounds, for example, from 2 to about 100 oxyalkylene compounds, or a condensed mixture of at least one oxyalkylene compound and at least one diol compound, wherein R" is independently selected from the group hydrogen and hydrocarbon substituents with from 1 to about 24 carbon atoms, n is an integer from about 2 to about 10,000, and m is an integer from about 2 to about 10,000.

Compositions of the present invention, embody: physical mixtures of a pigment, and a branched or linear polyester resin; and chemical mixtures of a pigment, and the polyester resin; and as illustrated herein.

In embodiments, the present invention provides compositions comprised of a pigment, and a linear polyester resin of the formula

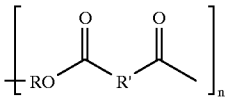

where R' is independently selected from the group consisting of phenylene, cyclohexylene, and alkylene with from 4 to about 24 carbon atoms, where R is an oxyalkylene compound, optionally in admixture with one or more diol compounds prior to condensation, of the formula

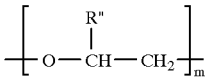

where R" is independently selected from the group hydrogen and hydrocarbon substituents with from 1 to about 24 carbon atoms, n is an integer from about 2 to about 10,000, and m is an integer from about 2 to about 10,000, and which composition is prepared by a process which comprises: heating under condensation conditions a mixture of one or more diacids of the formula

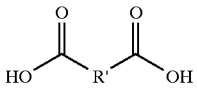

and one or more diols of the formula

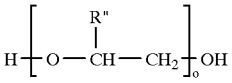

where o is an integer from about 2 to about 10,000, and thereafter heating and melt mixing the resulting polyester with at least one pigment.

In embodiments, toner compositions of the present invention can include oligomeric polyester compounds of the formula

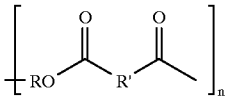

where n is from 15 to about 100 and comprised of a diacid of the formula

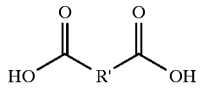

where R' is independently selected from phenylene, cyclohexylene, and alkylene with from 4 to about 24 carbon atoms, and an oxyalkylene compound and or a diol compound of the formula

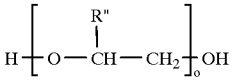

where R" is independently selected from the group hydrogen and hydrocarbon substituents with from 1 to about 24 carbon atoms, and o is an integer from about 2 to about 10,000.

Toner compositions of the present invention can include pigments, such as carbon black, magnetites, cyan, magenta, yellow, red, blue, green, brown, or mixtures thereof, in amounts of for example, from about 0.1 to about 50 weight percent, and other additional performance additives which enable the toner composition to be effectively manufactured, dispensed reliably in a printing machine, and perform reliably in development processes under a variety of ambient and environmental conditions. Examples of additional performance additives include, but are not limited to, wax components, charge control additives, surface additives, release agents, flow aids, and mixtures thereof. The charge additives can be incorporated into the toner bulk, or are presented to the toner surface and are present in amounts of from about 0.05 to about 5 weight percent, and there results a positively or negatively charged toner. Lubricant or release additives include wax components with, for example, a weight average molecular weight (Mw) of from about 1,000 to about 20,000. The wax component can be a compound of the formula R—$CO_2$—M where R is a hydrocarbon with from 2 to about 25 carbon atoms, and M is hydrogen, monovalent or divalent metal ions of Group IA and IIA of the periodic table of elements, and ammonium ions with from 0 to about 32 carbon atoms, and mixtures thereof; polyethylenes; polypropylenes; polyalkylene alcohol compounds; and mixtures thereof. The wax additive can be present in amounts from about 0.01 to about 10 weight percent based on the weight of the toner. Examples of wax additives include zinc stearate, and UNILIN alcohols available from Petrolite Corporation.

The polyester compositions of the present invention may further comprise useful and functional additives for providing high quality images and highly reliable image forming processes, such as a pigment or colorant for forming full color images; a wax; one or more charge control additives, for example, a mixture of two or more charge additives of different triboelectric charging polarity, and optional surface additives, for example, fumed silicas to enhance the flow of marking particles during manufacture, shipping, image development and cleaning. When a liquid marking composition is desired, the marking composition can further comprise a liquid carrier vehicle, and which liquid carriers are well known in the art and include, for example, water, hydrocarbons, such as NORPAR® solvents available from Exxon, and the like carrier liquids.

The present invention provides, in embodiments, methods of imaging which comprises formulating an electrostatic latent image on a negatively charged photoreceptor, affecting development thereof with the toner compositions comprised of low melt polyester resins as illustrated herein, and thereafter transferring the developed image to a suitable substrate. The transferred image is optionally permanently fixed to the substrate. In embodiments of th e present invention, xerographic and related marking technologies are selected for forming the The following examples are illustrative of the invention embodied herein. All amounts are by weight percent unless specified otherwise. Comparative data and Examples are also provided.

EXAMPLE I

Amorthous Polyester From Terephthalate, 1,2-Propanediol and Dipropyleneglycol with Diols in 70:30 Ratio A 1 liter Parr reactor equipped with a magnetic stirrer, distillation apparatus, an the bottom drain valve was charged with dimethyl terephthalate (375 g), 1,2-propanediol (250 g), dipropylene glycol (77 g), stearic acid (5.5 g), trimethylolpropane (5.2 g), and FASCAT 4100 (0.8 g) a butyl stannoic acid catalyst. The mixture was he a ted to 165° C. and stirred at 200 rpm for 1 hour, and then raised slowly to 1r90°C. over a four hour period during which methanol was collected in the distillation receiver. T he mixture was then heated to 200° C., and vacuum was applied from atmospheric temperature to 1 Torr over a 2 hour period, during which time 1,2-propanediol was collected in the distillation receiver. The temperature was then heated slowly to 220° C., and the vacuum decreased to 0.2 Torr over a 2 hour period. The reactor was the pressurized to atmospheric pressure, a nd the product discharged through the bottom drain valve. A $T_g$ of 61° C. and a melt index of 8.0 g/10 minutes at 117° C. (16.6 Kg) were observed for this branched polyester resin. A toner composition comprised of 95% by weight of the above prepared branched polyester and 5% REGAL 330® was then fabricated in an extruder at a barrel temperature of about 110° C., a screw rotational speed of about 60 revolutions per minute, and at a feed rate of about 10 grams per minute. The extruded material was then broken into coarse particles by passing through a Fitzmill (Model J) using a 425 micrometer screen. An 8-inch Sturtevant micronizer was then used to reduce the particle size further. Toner particle size of 6.9 microns and geometric particle size distribution of 1.34 was obtained using the the Coulter$^R$ Multisizer II available from Coulter Electronics. The fusing results for the toner are tabulated in Table 1.

EXAMPLE II

Amorphous Polyester From Terephthalate. 1,2-Propanediol and Dipropyleneglycol with Diols in 65:35 Ratio This branched polyester was synthesized according to Example I with the exception that a 65:35 ratio of 1,2-propanediol to dipropylene glycol was used. The $T_g$ of the resin was 58° C., with a melt index of 10.3 g/10 minutes at 117° C. (16.6 Kg). A toner composition comprised of 95% by weight of the branched polyester and 5% REGAL 330® was then fabricated as in Example I. The fusing results for the toner are tabulated in Table 1.

EXAMPLE III

Amorphous Polyester From Terephthalate, 1,2-Propanediol and Dipropyleneglycol with Diols in 60:40 Ratio This branched polyester was synthesized according to Example I with the exception that a 60:40 ratio of 1,2-propanediol to dipropylene glycol was used. The $T_g$ of the resin was 56° C., with a melt index of 20.8 g/10 minutes at 117° C. (16.6 Kg). A toner composition comprised of 95% by weight of the branched polyester and 5% REGAL 330® was then fabricated as in Example I. The fusing results for the toner are tabulated in Table 1.

EXAMPLE IV

Amorphous Polyester From Terephthalate, 1,2-Propanediol and Tripropylene Glycol with Diols in 85:15 Ratio A liter Parr reactor equipped with a magnetic stirrer, distillation apparatus, and bottom drain valve was charged with dimethyl terephthalate (375 g), 1,2-propanediol (250 g), tripropylene glycol (47 g), stearic acid (5.2 g), trimethylolpropane (5.5 g), and FASCAT 4100 (0.8 g) a butylstannoic acid catalyst. The mixture was heated to 165° C. and stirred at 200 rpm for 1 hour, and then raised slowly to 190° C. over a four hour period during which methanol was collected in the distillation receiver. The mixture was then heated to 200° C., and vacuum was applied from atmospheric temperature to 1 Torr over a 2 hour period, during which time 1,2-propanediol was collected in the distillation receiver. The temperature was then raised slowly to 220° C., and the vacuum decreased to 0.2 Torr over a 2 hour period. The reactor was then pressurized to atmospheric pressure, and the product discharged through the bottom drain valve. Toner fusing result for the toner are tabulated in Table 1.

EXAMPLE V

Amorphous Polyester from Terephthalate, 1,2-Propanediol and Polyethyleneoxide (PEO) Oligomer ($M_w$=2,000 g/mole)

A 1 liter Parr reactor equipped with a magnetic stirrer, distillation apparatus, and bottom drain valve was charged with dimethyl terephthalate (375 g), 1,2-propanediol (250 g), polyethylene oxide with an Mw of 2,000 g/mole (68 g), stearic acid (5.2 g), trimethylolpropane (5.5 g), and FASCAT 4100 (0.8 g) a butylstannoic acid catalyst. The mixture was heated to 165° C. and stirred at 200 rpm for 1 hour, and then raised slowly to 190° C. over a four hour period during which methanol was collected in the distillation receiver. The mixture was then heated to 200° C., and vacuum was applied from atmospheric temperature to 1 Torr over a 2 hour period, during which time 1,2-propanediol was collected in the distillation receiver. The temperature was then raised slowly to 220° C., and the vacuum decreased to 0.2 Torr over a 2 hour period. The reactor was then pressurized to atmospheric pressure, and the product discharged through the bottom drain valve. A $T_g$ of 21° C. was measured for the resulting branched polyester.

EXAMPLE VI

Semi-Crystalline Polyester from Terephthalate, 1,2-Propanediol and PEO Wax (Mw=8,000)

A 1 liter Parr reactor equipped with a magnetic stirrer, distillation apparatus, and bottom drain valve was charged with dimethyl terephthalate (375 g), 1,2-propanediol (250 g), polyethylene oxide with an Mw of 8,000 g/mole ( 112 g), stearic acid (5.2 g), trimethylolpropane (5.5 g), and FASCAT 4100 (0.8 g) a butylstannoic acid catalyst. The mixture was heated to 165° C. and stirred at 200 rpm for 1 hour, and then raised slowly to 190° C. over a four hour period during which methanol was collected in the distillation receiver. The mixture was then heated to 200° C., and vacuum was applied from atmospheric temperature to 1 Torr over a 2 hour period, during which time 1,2-propanediol was collected in the distillation receiver. The temperature was then raised slowly to 220° C., and the vacuum decreased to 0.2 Torr over a 2 hour period. The reactor was then pressurized to atmospheric pressure, and the product discharged through the bottom drain valve.

TABLE 1

Fusing Results (Xerox Model 1075 ™ Fuser Roll)

| Toner (5% REGAL 330 ®) | $T_g$ (Toner) in ° C. | MFT in ° C. | Fusing Latitude in ° C. |
|---|---|---|---|
| Xerox Model 1075 Control Toner | 62 | 164 ± 3 | 16 |
| Example I | 60.4 | 138 ± 6 (F-26) | 42 |
| Example II | 58.2 | 138 ± 4 (F-26) | 32 |
| Example III | 56.0 | 134 ± 7 (F-30) | 31 |

The fusing results in Table 1 are for a commercially available Xerox Model 1075™ styrene-butylmethacrylate control toner containing 5 percent REGAL 330 carbon black and cetyl pyridinium chloride as a charge control additive, and toners made from resins prepared in Examples I–III, respectively. The "F- values" represent a measure of the observed difference between the minimum fix temperature (MFT) of the control toner and the Example toners. Thus, in Example I, an F-26 value represents the difference of MFT of the control toner (164° C.) and the toner of Example I (138° C.) or 26° C.

EXAMPLE VII

Magnetic Toner Preparation and Evaluation

The polymer resin (74 weight percent of the total mixture) obtained by the polymerization processes in Example I is melt extruded with 10 weight percent of REGAL 330® carbon black and 16 weight percent of MAPICO BLACK® magnetite at 120° C., and the extrudate pulverized in a Waring blender and jetted to 8 micron number average sized particles. A positively charging magnetic toner may be prepared by surface treating the jetted toner (2 grams) with 0.12 gram of a 1:1 weight ratio of AEROSIL R972® (Degussa) and TP-302 a naphthalene sulfonate and quaternary ammonium salt (Nachem/Hodogaya SI) charge control agent.

Developer compositions may then be prepared by admixing 3.34 parts by weight of the aforementioned toner composition with 96.66 parts by weight of a carrier comprised of a steel core with a polymer mixture thereover containing 70 percent by weight of KYNAR®, a polyvinylidene fluoride, and 30 percent by weight of polymethyl methacrylate; the coating weight being about 0.9 percent. Cascade development may be used to develop a Xerox Model D photoreceptor using a "negative" target. The light exposure may be set between 5 and 10 seconds and a negative bias used to dark transfer the positive toned images from the photoreceptor to paper.

Fusing evaluations may be carried out with a Xerox Corporation 5028® soft silicone roll fuser, operated at 7.62 cm (3 inches) per second.

The glass transition temperature, minimum fix temperature, and fusing latitude values for exemplary polyester toners of the present invention were presented in Table 1 above. Hot offset temperatures of polyester resin containing toners are expected to be improved over toners prepared from conventional polyester resins or styrene-acrylate copolymer resins synthesized by a free radical polymerization processes. The fuser roll temperatures may be determined using an Omega pyrometer and was checked with wax paper indicators. The degree to which a developed toner image adhered to paper after fusing is evaluated using a Scotch® tape test. The fix level is expected to be excellent and comparable to that fix obtained with other toner compositions having high fix level properties, for example, where typically greater than 95 percent of the toner image remains fixed to the copy sheet after removing a tape strip as determined by a densitometer. Alternatively, the fixed level may be quantitated using the known crease test, reference the aforementioned U.S. Pat. No. 5,312,704.

Images may be developed in a xerographic imaging test fixture with a negatively charged layered imaging member comprised of a supporting substrate of aluminum, a photogenerating layer of trigonal selenium, and a charge transport layer of the aryl amine N,N'-diphenyl-N,N'-bis(3-methylphenyl)1,1'-biphenyl-4,4'-diamine, 45 weight percent, dispersed in 55 weight percent of the polycarbonate MAKROLON®, reference U.S. Pat. No. 4,265,990, the disclosure of which is totally incorporated herein by reference; images for toner compositions prepared from the copolymers derived from, for example, Example XI, are expected to be of excellent quality with no background deposits and of high resolution over an extended number of imaging cycles exceeding, it is believed, about 75,000 imaging cycles. Other toner compositions may be readily prepared by conventional means from the branched polyester polymer and copolyester resins of the present invention including colored toners, single component toners, multicomponent toners, toners containing special performance additives, and the like.

The polyester resins of the present invention find utility in a wide variety of applications such as the improvement of the rheological properties of thermoplastic resins by, for example blending with conventional polymers, improving the compatibility of polymer blends by adding small amounts of the polyesters as compatibilizing agents, improving the viscosity index of lubricating oils, the use of these materials as a dispersant, and improving the impact strength of polyphenylene ether resins. The polymers of the present invention can be prepared using a wide range of equivalent reactive organic diacids and diol and or glycol monomers to provide novel toner resin materials with desirable electrophotographic properties. As an example, low melt polyester resins may be used to modify the surface of carbon black and pigment particles to make the pigment particles more miscible with a host polymer or dispersing medium.

Other embodiments and modifications of the present invention may occur to one of ordinary skill the art subsequent to a review of the information presented herein; these embodiments and modifications, as well as equivalents thereof, are also included within the scope of this invention.

What is claimed is:

1. A toner comprised of a pigment, and a linear saturated polyester resin of the formula

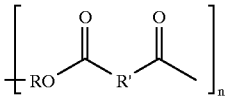

where R' is independently selected from the group consisting of phenylene, cyclohexylene, and alkylene with from 4 to about 24 carbon atoms, where R is comprised of a mixture of oxyalkylene groups of the formula

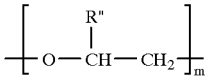

wherein R" is independently selected from the group consisting of hydrogen and hydrocarbon substituents with from 1 to about 24 carbon atoms, n is an integer from about 2 to about 10,000, and m is an integer from about 2 to about 10,000.

2. A toner composition in accordance with claim 1, wherein the polyester is amorphous.

3. A toner composition in accordance with claim 1, wherein the polyester is semicrystalline.

4. A toner composition in accordance with claim 1, wherein the toner has a glass transition temperature of from about 50 to about 65° C., a low minimum fix temperature of from about 120 to about 165° C. and a broad fusing latitude of from about 20 to about 45° C.

5. A toner composition in accordance with claim 1, wherein the toner has a high triboelectric charging value of from about 10 to about 30 and a high relative humidity stability of from about 1.0 to about 2.8.

6. A toner composition in accordance with claim 1, wherein the toner has a high jetting rate with a jetting ratio of from about less than or equal to 1.

7. A toner composition in accordance with claim 1, wherein the polyester further comprises a branching agent to provide a branched polyester, and wherein the branching agent is selected from the group consisting of trimethylolpropane, pentaerythritol, trimellitic acid, pyromellitic acid, and mixtures thereof, and which branching agent is selected in an amount of from about 0.1 to about 5 percent by weight based on the total weight percent of the polyester.

8. A toner composition in accordance with claim 1 wherein the polyester resin possesses a number average molecular weight(Mn) of from about 2,000 grams per mole to about 100,000 grams per mole, a weight average molecular weight(Mw) of from about 4,000 grams per mole to about 250,000 grams per mole, and polydispersity of from about 1.8 to about 17.

9. A toner composition in accordance with claim 1, further comprising at least one member selected from the group consisting of a wax component, a charge additive, a surface additive, and mixtures thereof.

10. A toner composition in accordance with claim 9 wherein a charge additive is incorporated into the toner, or is present on the surface of the toner composition and is present in an amount of from about 0.05 to about 5 weight percent, and there results a positively or negatively charged toner.

11. A toner composition in accordance with claim 9 wherein the wax component has a weight average molecular weight of from about 1,000 to about 20,000.

12. A toner composition in accordance with claim 11 wherein the wax component is independently selected from the group consisting of: a compound of the formula $R—CO_2—M$ where R is a hydrocarbon with from 2 to about 25 carbon atoms, and M is hydrogen, monovalent or divalent metal ions of Group IA and IIA of the periodic table of elements, and ammonium ions with from 0 to about 32 carbon atoms, and mixtures thereof; polyethylenes; polypropylenes; polyalkylene alcohol compounds; and mixtures thereof.

13. A toner composition in accordance with claim 1 wherein the pigment is carbon black, magnetites, cyan, magenta, yellow, red, blue, green, brown, or mixtures thereof, in an amount of from about 0.1 to about 50 weight percent.

14. A developer composition comprised of the toner composition of claim 1 and carrier particles.

15. A toner composition in accordance with claim 1 wherein the polyester is comprised of at least one diacid component and at least one diol component in a mole ratio of from about 0.9:1.1 to about 1.1:0.9.

16. A toner composition in accordance with claim 15 wherein 2 to about 10 different diols are selected for the oxyalkylene component.

17. A toner composition in accordance with claim 15 wherein from 2 to about 10 different diacids are selected for the diacid component.

18. A method of imaging which comprises formulating an electrostatic latent image on a negatively charged photoreceptor, affecting development thereof with the toner composition of claim 1, and thereafter transferring the developed image to a suitable substrate.

19. A method of imaging in accordance with claim 18 wherein the transferred image is permanently fixed to the substrate.

20. A toner composition in accordance with claim 1, wherein the mixture of oxyalkylene groups is selected from the group consisting of a 1,2-diol compound and a polyalkylene oxide compound, and wherein the weight ratio of the 1,2-diol compound and the polyalkylene oxide compound is from about 85:15 to about 55:45.

21. A toner composition in accordance with claim 20, wherein the 1,2-diol compound is 1,2-propane diol of the formula $HO—CH(CH_3)—CH_2—OH$, the polyalkylene oxide compound is polyethylene oxide, wherein R' is phenylene with 6 carbon atoms, and wherein m is from about 40 to about 350.

22. A toner composition in accordance with claim 20, wherein the 1,2-diol compound is 1,2-dipropane diol of the formula $HO—CH(CH_3)—CH_2—O—CH(CH_3)CH_2—OH$, the polyalkylene oxide compound is polyethylene glycol, wherein R' is phenylene with 6 carbon atoms, and wherein m is from about 40 to about 350.

23. A toner composition in accordance with claim 20, wherein the 1,2-diol compound is 1,2-ethane diol of the formula $HO—CH_2—CH_2—O—H$, the polyalkylene oxide compound is poly 1,2-propylene oxide, wherein R' is phenylene with 6 carbon atoms, and wherein m is from about 40 to about 350.

24. A toner composition in accordance with claim 20, wherein the 1,2-diol compound is 1,2-propane diol of the formula $HO—CH(CH_3)—CH_2—OH$, and the polyalkylene oxide compound is tetraoxyethylene diol of the formula $HO—CH_2—CH_2—O—CH_2—CH_2—O—CH_2—CH_2—O—CH_2—CH_2—OH$, and wherein m is from about 4 to about 8.

25. A toner composition in accordance with claim 1, wherein the polyester further comprises a covalently bonded end group comprised of a monocarboxylic acid.

26. A toner composition in accordance with claim 1, wherein the polyester further comprises a covalently bonded branching agent providing a branched polyester.

27. A toner comprised of a pigment, and a linear saturated polyester resin of the formula

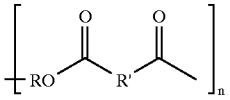

wherein R' is independently selected from the group consisting of phenylene, cyclohexylene, and alkylene with from 4 to about 24 carbon atoms, wherein R is a substituted oxyalkylene group of the formula

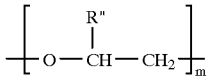

wherein R" is a hydrocarbon substituent with from 2 to about 24 carbon atoms, n is an integer from about 2 to about 10,000, and m is an integer from about 2 to about 10,000.

28. A toner composition in accordance with claim 27, wherein R' is phenylene with 6 carbon atoms, and wherein R is of the formula arising from 1,2-tetraethylene glycol.

29. A toner in accordance with claim 1 wherein the polyester is selected from the group consisting of poly (dioxypropylene-terephthalate), poly(trioxypropylene-terephthalate), poly(trioxyethylene-terephthalate), and poly (tetraoxyethylene-terephthalate).

* * * * *